US009953482B2

(12) United States Patent
Montenegro et al.

(10) Patent No.: US 9,953,482 B2
(45) Date of Patent: Apr. 24, 2018

(54) METHOD OF GAMING, A GAMING SYSTEM AND A GAME CONTROLLER

(75) Inventors: Daniel Julio Montenegro, Endeavor Hills (AU); Wade Clark, Ormond (AU)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 270 days.

(21) Appl. No.: 13/399,435

(22) Filed: Feb. 17, 2012
(Under 37 CFR 1.47)

(65) Prior Publication Data

US 2013/0045789 A1 Feb. 21, 2013

(30) Foreign Application Priority Data

Feb. 17, 2011 (AU) ..... 2011900538

(51) Int. Cl.
*A63F 9/24* (2006.01)
*G07F 17/32* (2006.01)
*G07F 17/34* (2006.01)

(52) U.S. Cl.
CPC ..... *G07F 17/32* (2013.01); *G07F 17/34* (2013.01)

(58) Field of Classification Search
CPC ..... G07F 17/32; G07F 17/34
USPC ..... 463/16, 20, 25, 42
See application file for complete search history.

(56) References Cited

U.S. PATENT DOCUMENTS 6,905,406 B2 * 6/2005 Kaminkow et al. ..... 463/20
7,329,180 B2 * 2/2008 Strom ..... 463/20
7,575,513 B2 * 8/2009 Strom ..... 463/13
7,591,724 B2 * 9/2009 Baerlocher ..... 463/20
8,298,065 B2 * 10/2012 Berman et al. ..... 463/20
2003/0054874 A1 * 3/2003 Kaminkow ..... 463/20
2003/0064802 A1 * 4/2003 Rodgers et al. ..... 463/30
2003/0130027 A1 7/2003 Aida
2003/0203752 A1 * 10/2003 Kaminkow et al. ..... 463/20
2003/0203753 A1 * 10/2003 Muir et al. ..... 463/20
2004/0033827 A1 * 2/2004 Gilmore et al. ..... 463/20
2004/0048652 A1 * 3/2004 Ching et al. ..... 463/20
2004/0137982 A1 * 7/2004 Cuddy et al. ..... 463/20
2005/0020344 A1 * 1/2005 Kaminkow ..... 463/16
2005/0101380 A1 * 5/2005 Glavich et al. ..... 463/25
(Continued)

FOREIGN PATENT DOCUMENTS

CA 2704002 5/2009
DE 102008053235 4/2010
(Continued)

*Primary Examiner* — Jay Liddle
*Assistant Examiner* — Ryan Hsu
(74) *Attorney, Agent, or Firm* — McAndrews, Held & Malloy, Ltd.

(57) ABSTRACT

A method of gaming in a gaming system. The method includes selecting symbols for display at a plurality of subsets of symbol display positions by independently determining stopping positions of reels of symbols associated with the subsets of display positions, wherein at least one subset of symbol display positions is associated with two or more reels and upon two or more symbols being selected for the same symbol display position at least one symbol combination rule is applied to the two or more symbols to determine a resultant symbol for display, and evaluating the displayed symbols to determine whether to make an award.

18 Claims, 8 Drawing Sheets

(56) References Cited

U.S. PATENT DOCUMENTS

| | | | | |
|---|---|---|---|---|
| 2006/0116196 | A1 | 6/2006 | Vancura | |
| 2006/0189363 | A1 | 8/2006 | Strom | |
| 2006/0189378 | A1* | 8/2006 | Aoki | G07F 17/3202 463/20 |
| 2006/0194629 | A1 | 8/2006 | Strom | |
| 2006/0252496 | A1 | 11/2006 | Rasmussen | |
| 2007/0060256 | A1 | 3/2007 | Yoshimura | |
| 2008/0064477 | A1 | 3/2008 | Fong et al. | |
| 2008/0113775 | A1* | 5/2008 | Williams | G07F 17/3202 463/25 |
| 2008/0287178 | A1* | 11/2008 | Berman | G07F 17/3211 463/20 |
| 2009/0312086 | A1 | 12/2009 | Kanellos et al. | |
| 2010/0016054 | A1 | 1/2010 | Berman et al. | |
| 2010/0029369 | A1 | 2/2010 | Pacey | |
| 2010/0123286 | A1 | 5/2010 | Green et al. | |
| 2010/0124974 | A1 | 5/2010 | Green et al. | |
| 2010/0151931 | A1* | 6/2010 | Jasper et al. | 463/20 |
| 2011/0201406 | A1* | 8/2011 | Jaffe | G07F 17/32 463/21 |

FOREIGN PATENT DOCUMENTS

| | | |
|---|---|---|
| GB | 2404874 | 2/2005 |
| JP | 2004081812 | 3/2004 |
| JP | 2008080162 | 4/2008 |
| JP | 2008086826 | 4/2008 |
| JP | 2008125991 | 6/2008 |
| JP | 2008155066 | 7/2008 |
| JP | 2008264214 | 11/2008 |
| JP | 2009095475 | 5/2009 |
| JP | 2010051739 | 3/2010 |
| JP | 2010051740 | 3/2010 |
| WO | 2005035080 | 4/2005 |
| WO | 2007030787 | 3/2007 |
| WO | 2007053349 | 5/2007 |
| WO | 2009039295 | 3/2009 |
| WO | 2010039411 | 4/2010 |

* cited by examiner

METHOD OF GAMING, A GAMING SYSTEM AND A GAME CONTROLLER

RELATED APPLICATIONS

This application claims priority to Australian Provisional Patent Application No. 2011900538 having an International filing date of Feb. 17, 2011, which is incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The invention relates to a method of gaming, a gaming system and a game controller.

Many gaming machines are reel based ("slot") machines where a plurality of reels are spun to a stop with a set of symbols displayed to the player. The displayed symbols are then evaluated by the gaming machine based on the player's wager to determine whether they include any winning symbol combinations.

While such gaming systems provide players with enjoyment, a need exists for alternative gaming systems in order to maintain or increase player enjoyment.

BRIEF SUMMARY OF THE INVENTION

In a first aspect, the invention provides a method of gaming in a gaming system, the method comprising:

selecting symbols for display at a plurality of subsets of symbol display positions by independently determining stopping positions of reels of symbols associated with the subsets of display positions, wherein at least one subset of symbol display positions is associated with two or more reels and upon two or more symbols being selected for the same symbol display position at least one symbol combination rule is applied to the two or more symbols to determine a resultant symbol for display; and evaluating the displayed symbols to determine whether to make an award.

In an embodiment, one of the two or more reels is a base reel comprising symbols at each of a plurality of symbol positions of the reel.

In an embodiment, another of the two or more reels is a modifier reel comprising symbols at a subset of a plurality of symbol positions of the reel.

In an embodiment, each reel comprises a symbol at each of the plurality of symbol positions of the reel.

In an embodiment, each subset of display positions is a column of display positions.

In an embodiment, a symbol combination rule is that the symbols are combined such that each resultant symbol is a composite symbol formed from the combined symbols.

In an embodiment, the method comprises evaluating the displayed symbols comprises comparing the displayed symbols to a prize table containing at least one entry corresponding to a possible composite symbol.

In an embodiment, a symbol combination rule that applies to at least one symbol is that the at least one symbol overrides any other symbol such the at least one symbol is displayed unmodified.

In an embodiment, the evaluation is based on a wager which applies to evaluation of the symbols.

In a second aspect, the invention provides a gaming system comprising:

a display for displaying symbols at a plurality of subsets of symbol display positions;

a memory storing a plurality of reels of symbols associated with the subsets of display positions, at least one subset of display positions being associated with two or more reels;

a symbol selector arranged to select symbols for display at the plurality of subsets of symbol display positions by independently determining stopping positions of reels of symbols associated with the subsets of display positions, wherein at least one subset of symbol display positions is associated with two or more reels and upon two or more symbols being selected for the same symbol display position at least one symbol combination rule is applied to the two or more symbols by the game controller to determine a resultant symbol for display; and a symbol evaluator arranged to evaluate the displayed symbols to determine whether to make an award.

In an embodiment, one of the two or more reels is a base reel comprising symbols at each of a plurality of symbol positions of the reel.

In an embodiment, another of the two or more reels is a modifier reel comprising symbols at a subset of a plurality of symbol positions of the reel.

In an embodiment, each reel comprises a symbol at each of the plurality of symbol positions of the reel.

In an embodiment, each subset of display positions is a column of display positions.

In an embodiment, a symbol combination rule is that the symbols are combined such that each resultant symbol is a composite symbol formed from the combined symbols.

In an embodiment, the symbol evaluator evaluates the displayed symbols by comparing the displayed symbols to a prize table containing at least one entry corresponding to a possible composite symbol.

In an embodiment, a symbol combination rule that applies to at least one symbol is that the at least one symbol overrides any other symbol such the at least one symbol is displayed unmodified.

In an embodiment, the evaluation is based on a wager which applies to evaluation of the symbols.

In a third aspect, the invention provides a game controller for a gaming system, the game controller arranged to:

select symbols for display at a plurality of subsets of symbol display positions by independently determining stopping positions of reels of symbols associated with the subsets of display positions, wherein at least one subset of symbol display positions is associated with two or more reels and upon two or more symbols being selected for the same symbol display position at least one symbol combination rule is applied to the two or more symbols by the game controller to determine a resultant symbol for display; and evaluate the displayed symbols to determine whether to make an award.

In an embodiment, one of the two or more reels is a base reel comprising symbols at each of a plurality of symbol positions of the reel.

In an embodiment, another of the two or more reels is a modifier reel comprising symbols at a subset of a plurality of symbol positions of the reel.

In an embodiment, each reel comprises a symbol at each of the plurality of symbol positions of the reel.

In an embodiment, each subset of display positions is a column of display positions.

In an embodiment, a symbol combination rule is that the symbols are combined such that each resultant symbol is a composite symbol formed from the combined symbols.

In an embodiment, the game controller is arranged to evaluate the displayed symbols by comparing the displayed symbols to a prize table containing at least one entry corresponding to a possible composite symbol.

In an embodiment, a symbol combination rule that applies to at least one symbol is that the at least one symbol overrides any other symbol such the at least one symbol is displayed unmodified.

In an embodiment, the evaluation is based on a wager which applies to evaluation of the symbols.

In a fourth aspect, the invention provides a gaming system comprising:

a display means for displaying symbols at a plurality of subsets of symbol display positions;

a plurality of reels of symbols associated with the subsets of display positions, at least one subset of display positions being associated with two or more reels;

means for selecting symbols for display at a plurality of subsets of symbol display positions by independently determining stopping positions of reels of symbols associated with the subsets of display positions, at least one subset of display positions being associated with two or more reels such that the means for selecting symbols (a) selects stopping positions for the two or more reels, and, upon two or more symbols being selected for a symbol display position, (b) applies at least one symbol combination rule to the two or more symbols to determine a resultant symbol for display; and means for evaluating the displayed symbols to determine whether to make an award.

In a fifth aspect, the invention provides computer program code which when executed implements the above method.

In a sixth aspect, the invention provides a tangible computer readable medium comprising the above program code.

BRIEF DESCRIPTION OF SEVERAL VIEWS OF THE DRAWINGS

An exemplary embodiment of the invention will now be described with reference to the accompanying drawings in which.

DETAILED DESCRIPTION OF THE INVENTION

Figure 1:
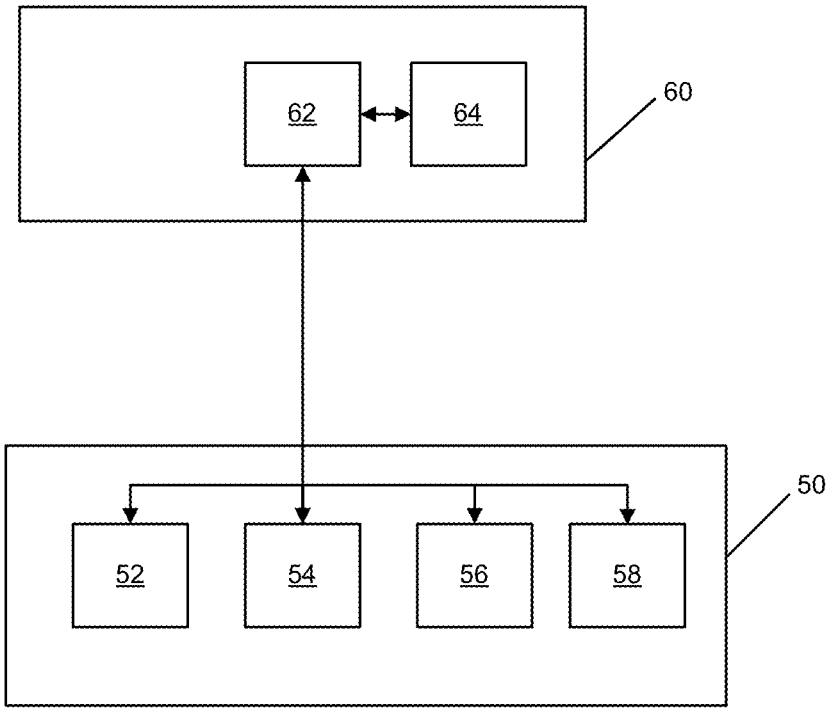
FIG. 1 is a block diagram of the core components of a gaming system.

Referring to the drawings, there is shown a gaming system having a game controller arranged to implement a spinning reel game where symbols are selected for a plurality of subsets of symbol display positions. Two or more reels correspond to at least one of the subsets of display positions and symbols are selected for the display positions to which they correspond by independently selecting stopping positions for each reel to determine which symbols of the reels correspond to the subset of display positions. In some embodiments each reel has symbols at each symbol position of the reel and those symbols are combined to form a resultant symbol which will be used in evaluation of the selected symbols of the reel. In some embodiments one reel only has symbols at some of the positions and symbols are combined upon two or more symbols being selected for a display position.

General Construction of Gaming System

The gaming system can take a number of different forms. In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system has several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits and receive payouts, one or more displays 54, a game play mechanism 56 including one or more input devices that enable a player to input game play instructions (e.g. to place a wager), and one or more speakers 58.

The game controller 60 is in data communication with the player interface and typically includes a processor 62 that processes the game play instructions in accordance with game play rules and outputs game play outcomes to the display. Typically, the game play rules are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server. That is a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
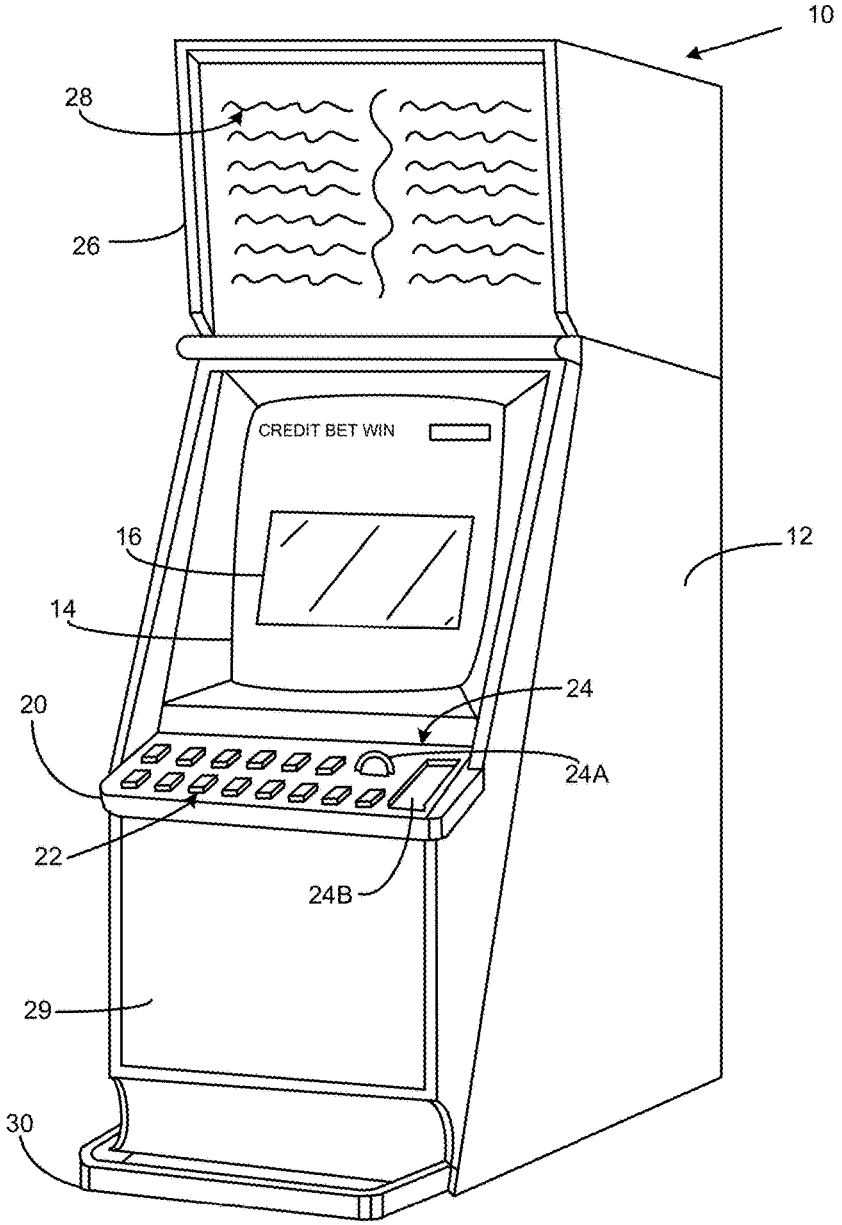
FIG. 2 is a perspective view of a stand alone gaming machine.

A gaming system in the form of a stand alone gaming machine 10 is illustrated in FIG. 2. The gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. Other gaming machines may configure for ticket in such that they have a ticket reader for reading tickets having a value and crediting the player based on the face value of the ticker. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit. The top box 26 may also include a display, for example a video display unit, which may be of the same type as the display 14, or of a different type.

Figure 3:
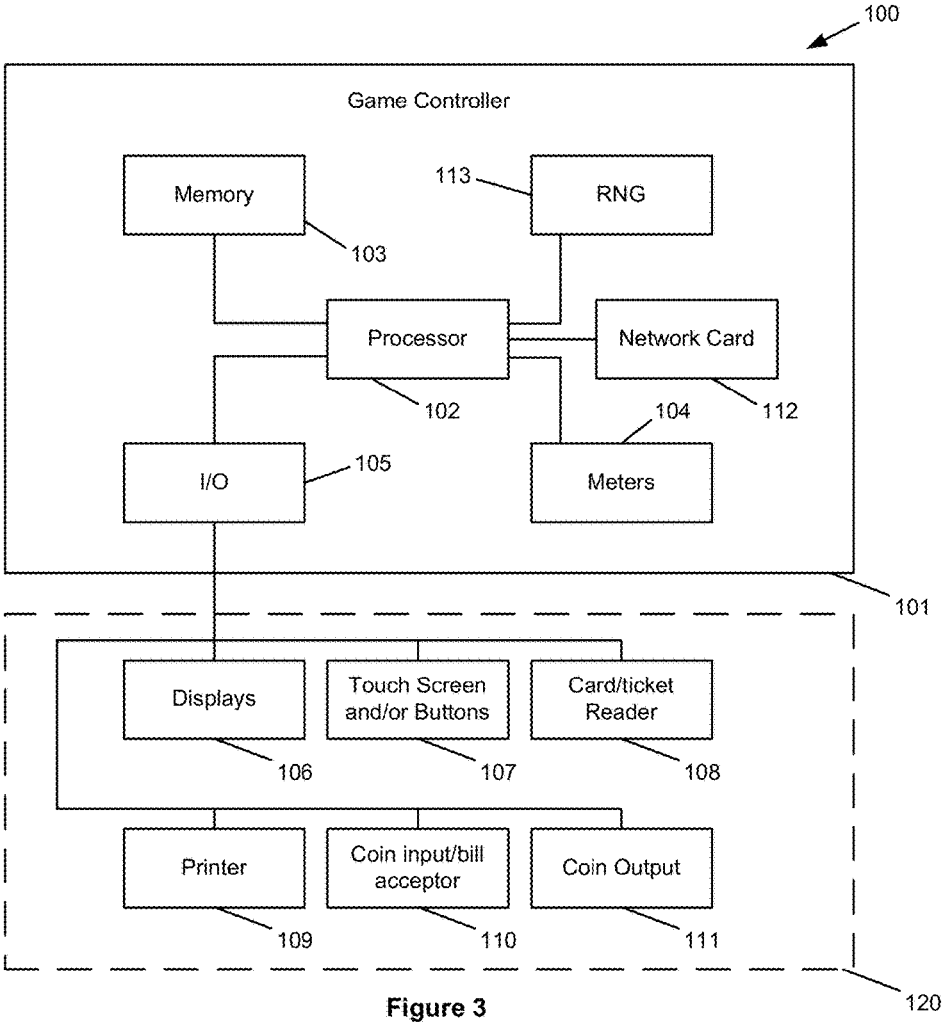
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, the gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
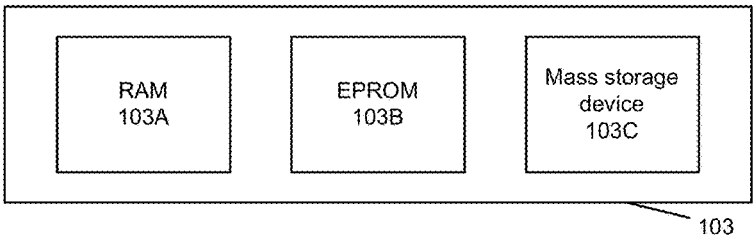
FIG. 4 is a schematic diagram of the functional components of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
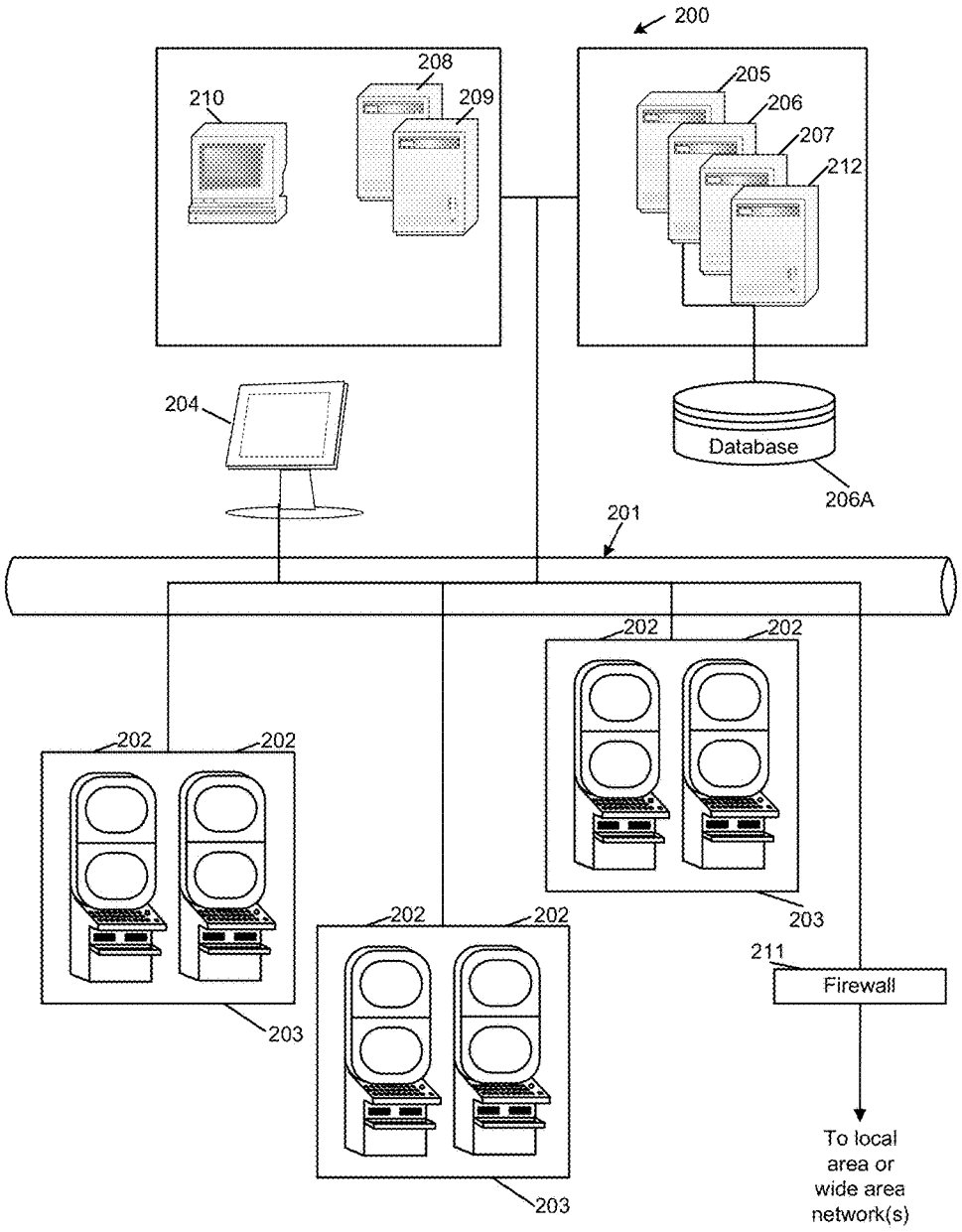
FIG. 5 is a schematic diagram of a network gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. For example, the displays 204 may be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

The player operates the game play mechanism 56 to specify a wager and hence the win entitlement which will be evaluated for this play of the game and initiates a play of the game. Persons skilled in the art will appreciate that a player's win entitlement will vary from game to game dependent on player selections. In most spinning reel games, it is typical for the player's entitlement to be affected by the amount they wager and selections they make (i.e. the nature of the wager). For example, a player's win entitlement may be based on how many lines they play in each game—e.g. a minimum of one line up to the maximum number of lines allowed by the game (noting that not all permutations of win lines may be available for selection) and how much they wager per line. Such win lines are typically formed by a combination of symbol display positions, one from each reel, the symbol display positions being located relative to one another such that they form a line.

In many games, the player's win entitlement is not strictly limited to the lines they have selected, for example, "scatter" pays are awarded independently of a player's selection of pay lines and are an inherent part of the win entitlement.

Persons skilled in the art, will appreciate that in other embodiments, the player may obtain a win entitlement by selecting a number of reels to play and an amount to wager per reel. Such games are marketed under the trade name "Reel Power" by Aristocrat Leisure Industries Pty Ltd. The selection of the reel means that each displayed symbol of the reel can be substituted for a symbol at one or more designated display positions. In other words, all symbols displayed at symbol display positions corresponding to a selected reel can be used to form symbol combinations with symbols displayed at a designated, symbol display positions of the other reels. For example, if there are five reels and three symbol display positions for each reel such that the symbol display positions comprise three rows of five symbol display positions, the symbols displayed in the centre row are used for non-selected reels. As a result, the total number of ways to win is determined by multiplying the number of active display positions of each reels, the active display positions being all display positions of each selected reel and the designated display position of the non-selected reels. As a result for five reels and fifteen display positions there are 243 ways to win.

Figure 6:
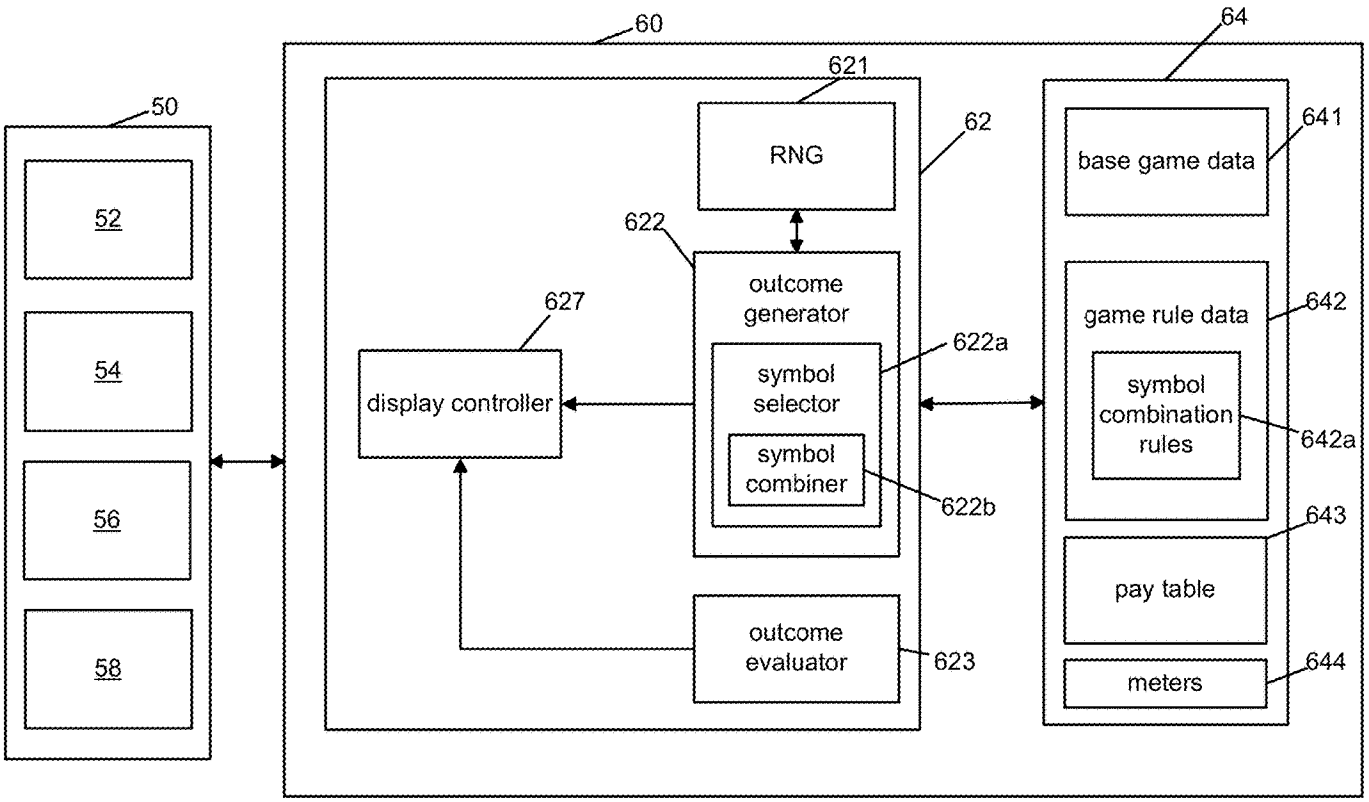
FIG. 6 is a further block diagram of a gaming system.

In FIG. 6, the processor 62 of game controller 60 is shown implementing a number of modules based on program code and data stored in memory 64. Persons skilled in the art will appreciate that various of the modules could be implemented in some other way, for example by a dedicated circuit.

These modules include the outcome generator 622 which operates in response to the player's operation of game play mechanism 56 to place a wager and initiate a play of the game and generates a game outcome which will then be evaluated by award evaluator 623. In an embodiment, to generate a game outcome, a symbol selector 622A of the outcome generator selects symbols from a set of symbols specified by symbol data 641 using random number generator 621. The selected symbols are advised to the display controller 624 which causes them to be displayed on display 54 at a set of symbol display positions comprising a plurality of subsets of symbol display positions.

In the embodiment, the symbol data specifies a plurality of spinning reels. For each reel there are a plurality of symbol positions on the reel, for example 20-24 symbol positions. As is known in the art, the symbol positions of a reel have a defined circular sequence with the last symbol position (e.g. symbol position 22) being followed by the first symbol position in the sequence. Accordingly, the symbol selector 622A selects all of the symbols for each of the reels by selecting a stopping position in the sequence for the respective reel. For example, if the symbol display positions are arranged in a plurality of columns and rows, one row may correspond to the stopping position. Persons skilled in the art will appreciate that it is known to use a probability table stored in memory 64 to vary the odds of a particular stop position being selected.

In the embodiment, at least one subset of display positions is associated with two or more reels. In one example, there are fifteen symbol display positions which are displayed on display 54 in a matrix made up of five columns and three rows, and two reels correspond to the central column. For each subset of display positions associated with two or more reels, the symbol selector selects stopping positions for each reel independently of the other reel or reels. In the embodiment, two reels are associated with a subset of display positions.

The selected symbols are then combined by symbol combiner 622*b* applying at least one symbol combination rule 642*a*. The symbol combination rules 642*a* may be related to the nature of the symbols and/or the nature of the reels. For example, in some embodiments, each reel of those which are to be combined has a symbol at each symbol position on the reel. In other embodiments, one of the reels only has symbols at some of the symbol positions. Accordingly, in embodiments where there are symbols on each symbol position on both reels, each pair of symbols which are selected for the same symbol display position will need to be combined. In other embodiments, where one of the reels only has symbols at some of the symbol display positions, symbols will only need to be combined upon two symbols being selected for the same symbol display position.

In one example, the symbols from one reel are base symbols and the symbols from another reel are modifier symbols. Each combination symbol is formed by the modifier symbols being added to the base symbols such that both the symbols originally selected are displayed but they form a composite symbol having both the base symbol and the modifier. In other embodiments, the symbols may be combined based on precedence rules. For example, a special symbol, such as a wild or a scatter symbol may take precedence over other symbols. For example, if a wild symbol is selected for a position (being a symbol which can take the place of any other symbol in the symbol combination) then a modifier symbol is not applied. In other embodiments, other precedence rules may be applied such that only one of two separate symbols selected for the position is displayed.

In one example using base and modifier symbols, the base symbols are the rank symbols of a set of cards (e.g. Ace, King, Queen, Jack, 10, 9 etc) and the modifier symbols are the suits: hearts, spades, clubs and diamonds. Accordingly, in this embodiment, the modifier applies a suit to the relevant rank. In this embodiment, different rank symbols may take on different suits from game round to game round. In such embodiments, the composite symbol may be displayed in a number of ways. In one example, the ranking card is transformed depending on the suit. For example, a King of hearts looks different to a King of clubs. In other embodiments, the base symbol may not be altered. In another example, the reel symbols of the base reel may include a combination of ranking symbols and other symbols and only ranking symbols acquire a suit under the combination rule.

In the embodiment, the reels for a subset of display positions are displayed by a display controller 624 as spinning independently. For example, by firstly spinning the reel having the base symbols and secondly spinning the reel having the modifier symbols. The display 54 is controlled by the display controller 624.

After the symbols have been selected, outcome evaluator 623 evaluates the symbols based on the pay table 643. In one example, the pay table contains some entries which corresponds to a composite symbol. For example, a winning combination comprised of four Aces including the central reel may have a higher payout in pay table 643 when the central symbol is a heart than a combination where the central symbol is a club. Alternatively, or in addition, the modifier symbols may modify the function of a symbol, such that a symbol with a modifier can participate in winning certain combinations whereas a symbol without a modifier cannot. In one example, in addition to five of a kind or other "of a kind" type winning combinations in the pay table, other types of winning combinations may be available for symbol combinations which include a modifier symbol. For example, winning combinations made up of symbols having the same modifier.

Once the outcome evaluator 623 has evaluated the displayed symbols, if there is any win, the outcome evaluator causes the display controller to display the win and updates the win meters of win meter data 644.

Figure 7:
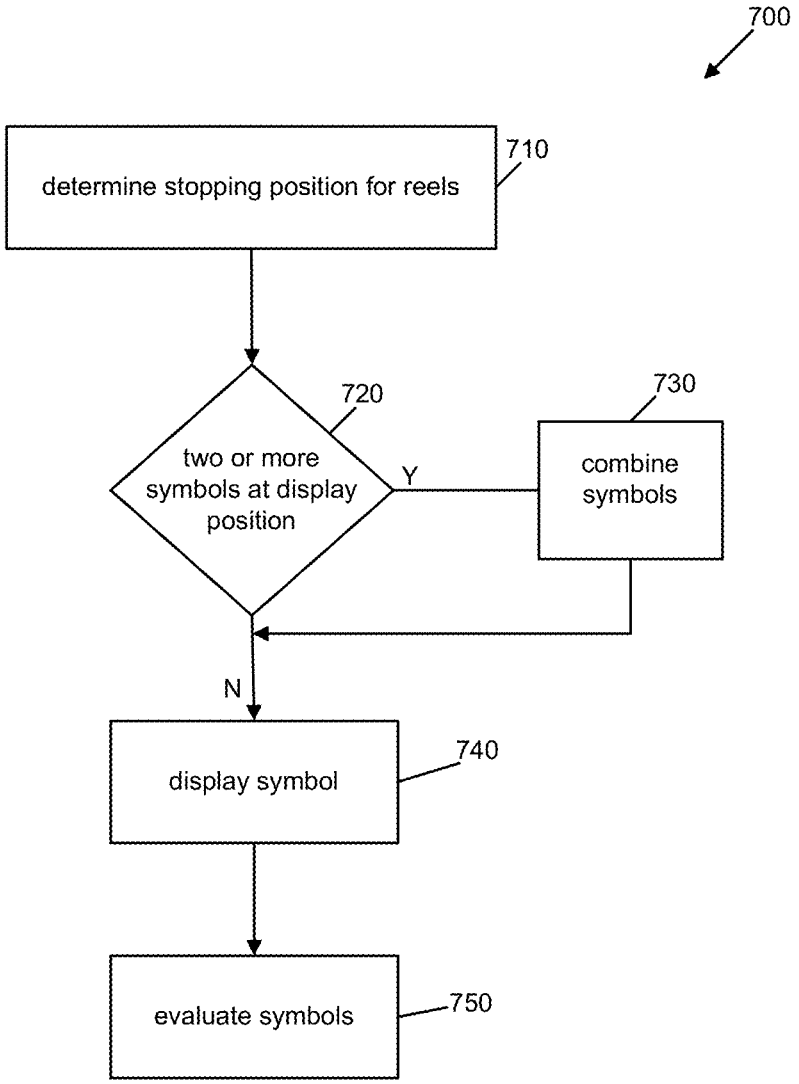
FIG. 7 is a flow chart of an embodiment.

A method of the embodiment is summarised in FIG. 7. The method 700 involves determining 710 stopping positions for a plurality of reels. Determining 720 whether there are two or more symbols at a display position and upon there being two or more symbols, combining those symbols 730. The symbols are then displayed 740 on display 54 and evaluated 750 by the outcome evaluator 623. Persons skilled in the art will appreciate that embodiments where there are expected to be two or more symbols at each display position, it is not strictly necessary to determine whether there are two or more symbols and the method can proceed directly to combining symbols in accordance with the symbol combination rules.

Further aspects of the method will be apparent from the above description of the system. It will be appreciated that at least part of the method will be implemented digitally by a processor. Persons skilled in the art will also appreciate that the method could be embodied in program code. The program code could be supplied in a number of ways, for example on a tangible computer readable storage medium, such as a disc or a memory (for example, that could replace part of memory 103) or as a data signal (for example, by transmitting it from a server). Persons skilled in the art, will appreciate that program code provides a series of instructions executable by the processor.

In the embodiment, the game is provided as a base game which is a part of the game which is carried out each time the player makes a wager, typically irrespective of the wager, whereas other parts of the game will only be carried out occasionally for example if a condition is met such as a trigger occurring or if an ante bet is placed (depending on the specific embodiment). In such embodiments, the outcome generator generates additional parts of the game outcome based on game rule data 642. For example, a feature game may be provided. Persons skilled in the art will appreciate that a feature game involves some additional element of game play which usually only occurs when a trigger condition is met. Types of feature games include: those where a series of free game events are awarded such as free games or re-spins (where some reels are held while others are re-spun); games where the symbols on the reel are changed; and "second screen" games where game play is totally different to the base game, for example where the player makes selections in a "pick a box type" game. In another embodiment, the game could be provided as the feature game, e.g. symbols are selected from two or more sets for a reel in a triggered free game series.

The trigger event may be, a symbol combination in the game, occurrence of a specific symbol in the game, purchased, be caused by another connected system, based on turnover, based on a random evaluation, etc.

In some embodiments, the feature of symbols being selected from two or more reels for one or more of the columns of symbol display positions may only be provided if an eligibility criteria is met, for example that the player has made a certain sized wager, made an ante bet, selected all win lines, played sufficient games, or the player is a member of a loyalty program.

Persons skilled in the art will appreciate that more than two reels could be combined to allow for more permutations of possible composite symbols. Further, any number of subsets of display positions could be associated with two or more reels. In another embodiment, the number of reels associated with a subset of display positions could vary during the game. In another embodiment the number of subsets of display positions associated with two or more reels could vary during the game.

EXAMPLE

Figure 8A:
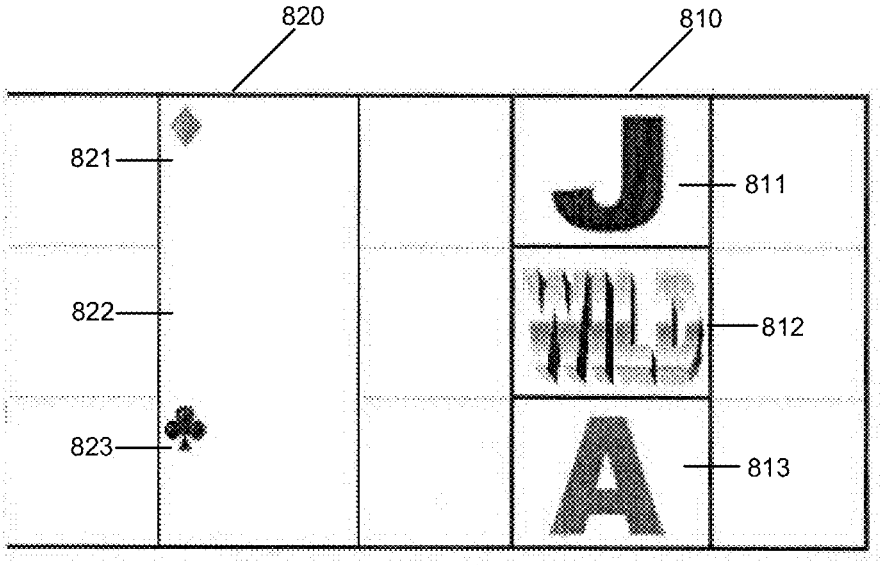
FIGS. 8*a* and 8*b* illustrate how symbols from two reels may be combined at a single symbol display position.
Figure 8B:
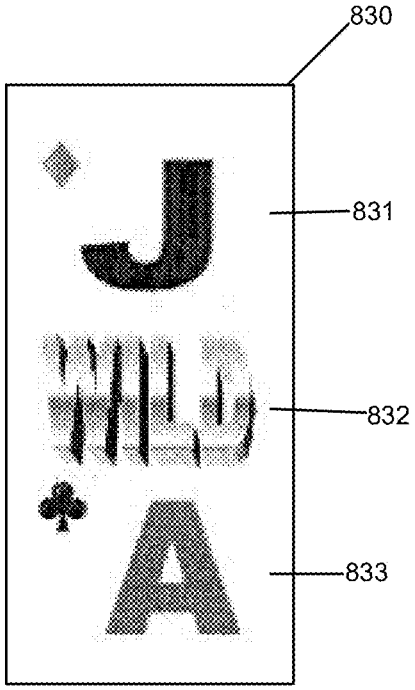

FIG. 8*a* shows an example where there is a base reel 810 and a modifier reel 820 which are used to select symbols for a single set of display positions. FIG. 8*a* shows the two reels having been stopped. The base reel has a Jack symbol at position 811, a wild symbol at position 812 and an Ace symbol at position 813. The modifier reel has a diamond symbol at position 821, no modifier symbol at symbol position 822 and a club symbol at position 823. Accordingly, as shown in FIG. 8*b*, a composite outcome reel 830 is then produced having a Jack of diamonds symbol 831, a wild symbol 832 and an Ace of clubs symbol 833.

Figure 9:
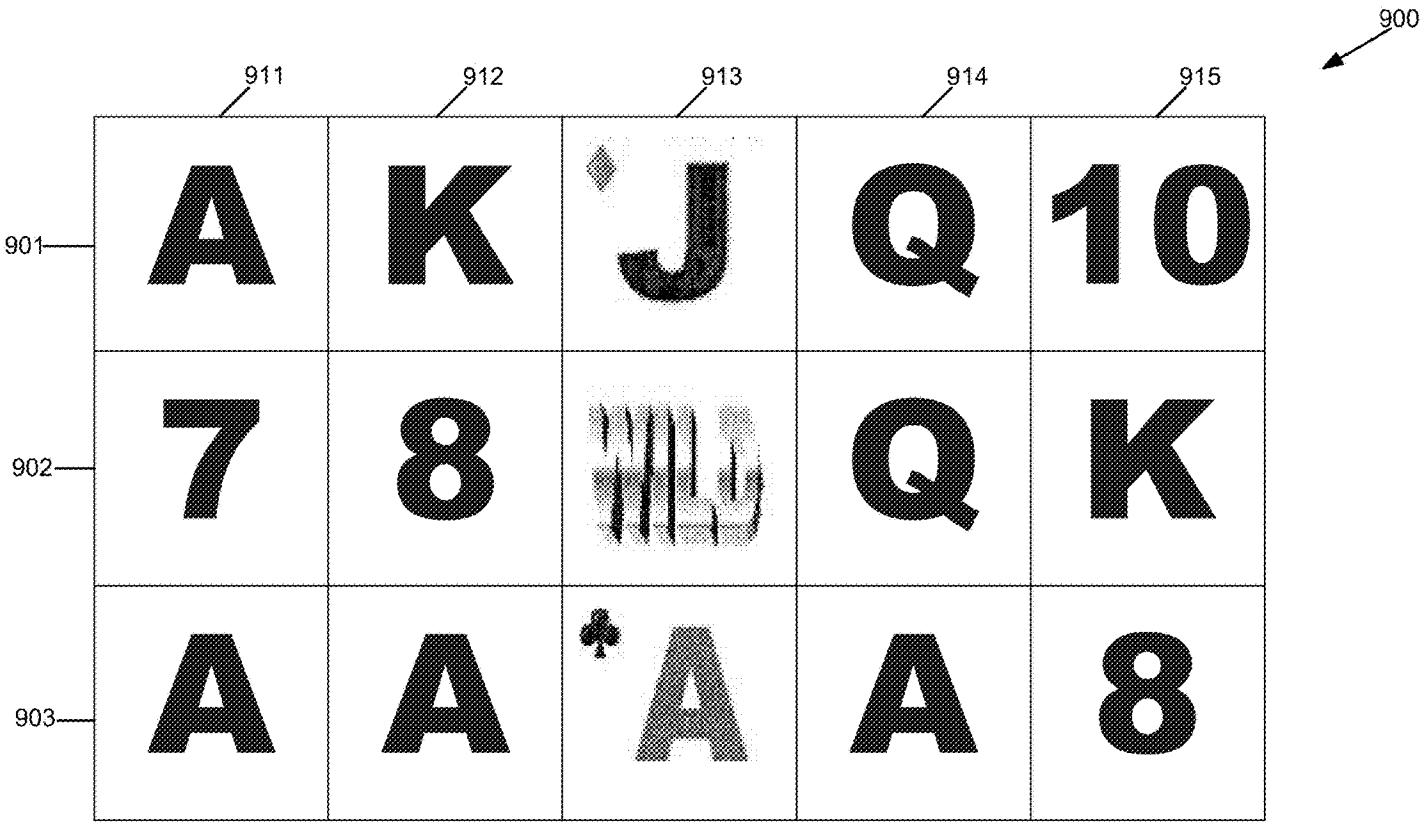
FIG. 9 is an example of a game outcome.

FIG. 9 then shows an example of the display 900 of a plurality of display positions where the composite reel 913 is displayed at a middle column 913 of 5 columns 911, 912, 914 and 915. In the example, there are three pay lines corresponding to respective ones of the rows of symbols 901, 902, 903.

Under the rules of the game, winning combinations are evaluated left to right with the exception that awards for a straight of symbols can be evaluated independently of the order of the symbols if a modifier symbol is applied. Accordingly, in the example, the player receives two awards for the symbol combinations shown in FIG. 9. The player wins a first award for four Aces of clubs because the Ace symbol on win line 903 has a club symbol applied to it. The player also wins for a straight comprised of the Ace, King, Jack, Queen and 10 on line 901 because the diamond symbol means that the Jack symbol can be evaluated out of order. That is, absent a diamond symbol this would not have been a winning combination as it would have been evaluated left to right, requiring the Queen and Jack to be reversed.

It will be understood to persons skilled in the art of the invention that many modifications may be made without departing from the spirit and scope of the invention, in particular it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming in a gaming system having a gaming machine, the gaming machine comprising a credit input mechanism configured to receive player interaction to accept a credit input associated with a monetary value for establishing a credit balance, the credit balance being increasable and decreasable, an output mechanism configured to cause a payout associated with the credit balance, a game controller, a plurality of reels of base symbols, one reel of modifier symbols, and a display having a plurality of display positions comprising a plurality of subsets of display positions, at least one of the plurality of subsets of display positions being associated with both one of the reels of base symbols and the one reel of modifier symbols, the method comprising:

establishing a credit balance via said credit input mechanism receiving player interaction;

selecting, via the game controller, in accord with having established the credit balance with the credit input mechanism, a plurality of symbols for presentation at the plurality of subsets of display positions of the display, said selecting including independently determining stopping positions of the plurality of reels of base symbols associated with the plurality of subsets of display positions and the stopping position of the one reel of modifier symbols;

displaying the selected plurality of symbols at the plurality of subsets of display positions of the display;

forming a single composite reel having a plurality of composite symbols, wherein the single composite reel is formed by merging the said one of the reels of base symbols and the said one reel of modifier symbols;

causing the display to replace the two associated reels with the single composite reel, the selected plurality of symbols at the plurality of subsets of display positions of the display including the symbols of the single composite reel forming displayed base symbols and modifier symbols;

evaluating via the game controller the displayed base symbols and modifier symbols; and making via the game controller an award based on said evaluating of the displayed base symbols and modifier symbols.

2. The method of gaming as claimed in claim 1, wherein each of the plurality of reels of base symbols comprises a base symbol at each of the plurality of symbol positions of the reel.

3. The method as claimed in claim 1, wherein each subset of display positions is a column of display positions.

4. The method as claimed in claim 1, comprising evaluating the displayed base symbols according to a predefined rule based on an order of the displayed base symbols by comparing the displayed base symbols to a prize table containing at least one entry corresponding to the symbols of the single composite reel.

5. The method as claimed in claim 1, comprising evaluating the displayed base symbols according to a predefined rule based on an order of the displayed base symbols by evaluating the displayed base symbols according to the order of the displayed base symbols and a wager made at the credit input mechanism.

6. A gaming system comprising:

a gaming machine comprising:

a credit input mechanism configured to receive player interaction to accept a credit input associated with a monetary value for establishing a credit balance, the credit balance being increasable and decreasable;

an output mechanism configured to cause a payout associated with the credit balance;

a plurality of reels of base symbols;

one reel of modifier symbols;

a display having a plurality of display positions comprising a plurality of subsets of display positions, at least one of the plurality of subsets of display positions being associated with both one of the reels of base symbols and the one reel of modifier symbols; and a controller configured to:

select in accord with having established the credit balance with the credit input mechanism, a plurality of symbols for presentation at the plurality of subsets of display positions of the display, said selecting including independently determining stopping positions of the plurality of reels of base symbols associated with the plurality of subsets of display positions and the stopping position of the reel modifier symbols;

display the selected plurality of symbols at the plurality of subsets of display positions of the display;

form a single composite reel having a plurality of composite symbols, wherein the single composite reel is formed by merging the said one of the reels of base symbols and the said one reel of modifier symbols;

cause the display to replace the two associated reels with the single composite reel, the selected plurality of symbols at the plurality of subsets of display positions of the display including the symbols of the single composite reel forming displayed base symbols and modifier symbols;

evaluate the displayed base symbols and modifier symbols; and make an award based on said evaluation of the displayed base symbols and modifier symbols.

7. The gaming system as claimed in claim 6, wherein each of the plurality of reels of base symbols comprises a base symbol at each of the plurality of symbol positions of the reel.

8. The gaming system as claimed in claim 6, wherein each subset of display positions is a column of display positions.

9. The gaming system as claimed in claim 6, wherein the controller is configured to evaluate the displayed base symbols according to a predefined rule based on an order of the displayed base symbols by comparing the displayed base symbols to a prize table containing at least one entry corresponding to the symbols of the single composite reel.

10. The gaming system as claimed in claim 6, wherein the controller is configured to evaluate the displayed base symbols according to a predefined rule based on an order of the displayed base symbols by evaluating the displayed base symbols according to the order of the displayed base symbols and a wager made at the credit input mechanism.

11. A game controller for a gaming system having a gaming machine comprising a credit input mechanism configured to receive player interaction to accept a credit input associated with a monetary value for establishing a credit balance, the credit balance being increasable and decreasable, an output mechanism configured to cause a payout associated with the credit balance, a plurality of reels of base symbols, one reel of modifier symbols, and a display having a plurality of display positions comprising a plurality of subsets of display positions, at least one of the plurality of subsets of display positions being associated with both one of the reels of base symbols and the one reel of modifier symbols, the game controller configured to:

select, in accord with having established the credit balance with the credit input mechanism, a plurality of symbols for presentation at the plurality of subsets of display positions of the display of the gaming machine at the plurality of subsets of display positions and to independently determine stopping positions of the plurality of reels of base symbols associated with the plurality of subsets of display positions and the stopping position of the one reel of modifier symbols;

display the selected plurality of symbols at the plurality of subsets of display positions of the display;

form a single composite reel having a plurality of composite symbols, wherein the single composite reel is formed by merging the said one of the reels of base symbols and the said one reel of modifier symbols;

cause the display to replace the two associated reels with the single composite reel, the selected plurality of symbols at the plurality of subsets of display positions of the display including the symbols of the single composite reel forming displayed base symbols and modifier symbols;

evaluate the displayed base symbols and modifier symbols; and make an award based on said evaluation of the displayed base symbols and modifier symbols.

12. The game controller as claimed in claim 11, wherein each of the plurality of reels of base symbols comprises a base symbol at each of the plurality of symbol positions of the reel.

13. The game controller as claimed in claim 11, wherein each subset of display positions is a column of display positions.

14. The game controller as claimed in claim 11, configured to evaluate the displayed base symbols according to a predefined rule based on an order of the displayed base symbols by comparing the displayed base symbols to a prize table containing at least one entry corresponding to the symbols of the single composite reel.

15. The game controller as claimed in claim 11, configured to evaluate the displayed base symbols according to a predefined rule based on an order of the displayed base symbols by evaluating the displayed base symbols based on the order of the displayed base symbols and a wager made at the credit input mechanism.

16. The game controller as claimed in claim 11, wherein the game controller configured to cause the display to replace the two associated reels with the single composite reel comprises the replacement of the two associated reels arranged adjacently in the same horizontal or vertical direction with the single composite reel arranged in the same horizontal or vertical direction.

17. The method as claimed in claim 1, wherein the causing the display to replace the two associated reels with the single composite reel comprises the replacement of the two associated reels arranged adjacently in the same horizontal or vertical direction with the single composite reel arranged in the same horizontal or vertical direction.

18. The gaming system as claimed in claim 6, wherein the controller configured to cause the display to replace the two associated reels with the single composite reel comprises the replacement of the two associated reels arranged adjacently in the same horizontal or vertical direction with the single composite reel arranged in the same horizontal or vertical direction.

* * * * *